US007311421B1

(12) United States Patent
Fahl

(10) Patent No.: US 7,311,421 B1
(45) Date of Patent: Dec. 25, 2007

(54) SPINNING ILLUMINATED ORNAMENT

(76) Inventor: Robert Michael Fahl, 5521 Timothy Dr., San Diego, CA (US) 92105

( * ) Notice: Subject to any disclaimer, the term of this patent is extended or adjusted under 35 U.S.C. 154(b) by 0 days.

(21) Appl. No.: 11/434,995

(22) Filed: May 16, 2006

Related U.S. Application Data

(63) Continuation of application No. 10/830,552, filed on Apr. 23, 2004, now abandoned.

(51) Int. Cl.
*F21V 21/14* (2006.01)
*H01R 39/08* (2006.01)

(52) U.S. Cl. ..... 362/250; 362/252; 362/287; 248/521; 439/21

(58) Field of Classification Search ..... 362/250, 362/252
See application file for complete search history.

(56) References Cited

U.S. PATENT DOCUMENTS 1,971,300 A * 8/1934 Garrett ..... 248/522
2,416,802 A * 3/1947 Roung ..... 439/13
2,587,788 A * 3/1952 Tacy ..... 362/35
3,652,972 A * 3/1972 Kreider ..... 439/21
3,723,723 A * 3/1973 Lerner ..... 362/251
4,214,296 A * 7/1980 Magett ..... 362/35
5,255,886 A * 10/1993 Wang ..... 248/522
5,647,569 A * 7/1997 Sofy ..... 248/522
6,132,063 A * 10/2000 Byers ..... 362/252
6,379,021 B1 * 4/2002 Shieh ..... 362/123
2003/0235049 A1 * 12/2003 Wu ..... 362/252

* cited by examiner

*Primary Examiner*—Jong-Suk (James) Lee
*Assistant Examiner*—Ismael Negron
(74) *Attorney, Agent, or Firm*—Goldstein Law Offices P.C.

(57) ABSTRACT

An ornament having an upper hub, a lower hub, a platform, a central pole and a coil. The upper hub is mounted directly on top of the lower hub with the platform permanently attached to the lower hub for attachment to virtually any smooth surface. The coil wraps around the pole, which is threaded and mates with internal grooves in the upper hub. The coil includes a string of lights plugged into an electrical outlet in the upper hub. The upper hub freely rotates with respect to the lower hub, which remains stationary. To maintain electrical contact between the lights and a power supply, copper tabs protrude from the lower hub and extend into copper rings in the upper hub.

3 Claims, 7 Drawing Sheets

SPINNING ILLUMINATED ORNAMENT

CROSS REFERENCES AND RELATED SUBJECT MATTER

This application is a continuation of patent application Ser. No. 10/830,552 filed in the United States Patent Office on Apr. 23, 2004 now abandoned.

BACKGROUND OF THE INVENTION

1. Field of the Invention

The invention generally relates to a Christmas ornament, and in particular it relates to a Christmas ornament that displays a string of Christmas lights on a spinning upper hub.

2. Description of the Related Art

The Christmas season is a festive time of the year that is celebrated throughout the world. The annual celebration of the birth of Jesus Christ is marked by more than 1.2 billion people who are professedly Christian and are associated, however loosely, with a Christian denomination. In the West, Christmas occurs on December 25. However, the Christmas season, which is also referred to as Christmastide or Yuletide, extends from December 24, Christmas Eve, to January 6, Epiphany. Over the years, decorating has become closely associated with Christmas in the public mind. In addition to a traditional tree, colorful lighting sets are commonly used to enhance the festive atmosphere of the season. So-called Christmas lights, consisting of numerous small bulbs connected in series along a segment of coated wiring, are often draped over Christmas trees and windows and wrapped around different exterior portions of homes. Since these lights almost always rest on, or are attached to, stationary objects, consumers rarely enjoy the beautiful and captivating sight of them spinning. Hence, there is an unmet need for an ornament that can simultaneously display Christmas lights and rotate continuously, and does not necessitate another decoration being used therewith.

U.S. Pat. No. 3,042,350 to Lencioni ("Lencioni"), U.S. Pat. No. 5,255,886 to Wang ("Wang") and U.S. Pat. No. 5,647,569 to Sofy ("Sofy") teach a stand that can be used to revolve a Christmas tree. However, in order to effectively utilize the stands of Lencioni, Wang and Sofy a user must first expend considerable effort mounting and decorating a Christmas tree.

While these devices may be suitable for the particular purposes employed, or for general use, they would not be as suitable for the purposes of the present invention as disclosed hereafter.

SUMMARY OF THE INVENTION

It is an object of the invention to provide a Christmas ornament that can be utilized in different areas of a home. Accordingly, the lower hub of the Christmas ornament permanently attaches to a platform that can be bolted to virtually any smooth surface.

It is another object of the invention to provide a Christmas ornament that displays Christmas lights and does not necessitate another decoration being used therewith. Accordingly, the Christmas ornament has a coil that wraps symmetrically around a central pole and an electrical outlet. A user can readily drape a string of Christmas lights around the coil and plug the lights into the outlet.

It is a further object of the invention to provide a Christmas ornament that freely rotates. Accordingly, a bearing is fitted into coaxial holes in the centers of the upper hub and the lower hub of the Christmas ornament that allows the upper hub to freely rotate in a clockwise or counterclockwise direction.

It is a further object of the invention to provide a Christmas ornament that allows the Christmas lights which it displays to remain illuminated as it rotates. Accordingly, a plurality of copper tabs protrude from a connector embedded in the lower hub of the Christmas ornament and extend to come into contact with the concentric copper rings embedded in the upper hub. The Christmas lights thereby maintain electrical contact with the power supply.

It is another object of the invention to provide an ornament that easily connects within a ceiling fan. Accordingly, in one embodiment the ornament of the invention is in an inverted position, where the lower hub is connected to an adapter which inserts into a light bulb socket of a standard ceiling fan.

It is another object of the invention to provide one continuous ornament extending from the ceiling to the floor. Accordingly, in one embodiment a first ornament is in an inverted position, wherein the lower hub is connected to the adapter, which is inserted into the light bulb socket. The first ornament is connected to a second ornament positioned on a ground surface, such that the combination of the first and second ornament, creates one continuous unit extending from the ceiling to the floor.

It is another object of the invention to provide an ornament that accommodates a plurality of strands of light. Accordingly, in one embodiment the upper hub of the ornament has a rim that contains a plurality of holes which accommodate strands of lights.

The invention is a Christmas ornament that has an upper hub, a lower hub, a platform, a central pole and a coil. The upper hub is mounted directly on top of the lower hub. The platform is permanently attached to the lower hub and can be bolted to virtually any smooth surface. The bottom end of the pole is threaded and mates with internal grooves in the upper hub. The coil wraps around the pole in a generally symmetric manner. A user can drape a string of Christmas lights around the coil and plug it into an electrical outlet in the upper hub. The upper hub freely rotates in a clockwise or counterclockwise direction with respect to the lower hub, which remains stationary. To maintain electrical contact between the lights and a power supply, copper tabs protrude from the lower hub and extend into copper rings in the upper hub.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
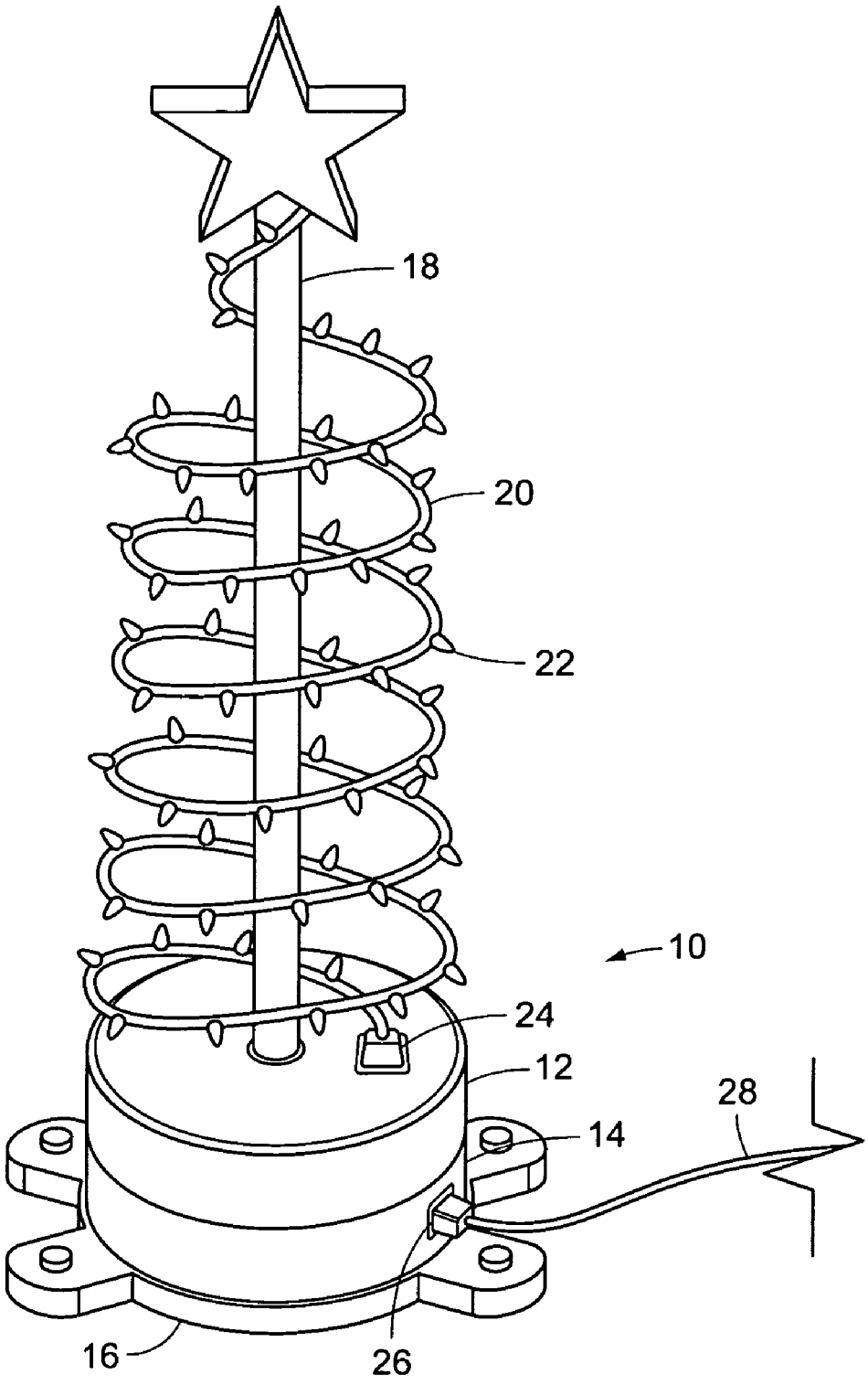
FIG. 1 is a diagrammatic perspective view of a Christmas ornament according to the present invention mounted in an upright position and being used with a string of Christmas lights.

FIG. 1 depicts a Christmas ornament 10 according to the present invention. The ornament 10 has an upper hub 12, a lower hub 14, a platform 16, a pole 18 and a coil 20. The upper hub 12 is mounted directly on top of the lower hub 14, with which it is substantially coextensive. Preferably, the upper hub 12 and the lower hub 14 have cylindrical configurations with circular cross-sectional areas and equal heights. However, other geometries such as cylinders with square or triangular cross-sectional areas and different heights can also be employed. The pole 18 extends vertically through the center of the upper hub 12. The coil 20 permanently attaches to the pole 18 at points near its top end and its bottom end. In between these two points, the coil 20 wraps symmetrically, but not necessarily uniformly, around the pole 18. Thus, the radial distances between comparable positions on the coil 20 and the pole 18 are equal for any particular turn of the coil 20, but can vary from each other along the length of the pole 18.

A user has draped a string of Christmas lights 22 evenly around the coil 20. The string of lights 22 plugs into an electrical outlet 24 in the upper hub 12. A standard power cord 28 extends from an electrical inlet 26 in the lower hub 14 to a wall receptacle. The upper hub 12 may freely rotate in a clockwise or counterclockwise direction while the lower hub 14 remains stationary and the lights 22 illuminate. Thus, the user can enjoy the beautiful sight of spinning Christmas lights while an electrical connection is maintained with a fixed power source. The ornament 10 continues to operate in this manner until the user interrupts flow of the alternating or direct current by unplugging the string of lights 22 from the outlet 24 or unplugging the cord 28 from the wall receptacle.

Figure 2:
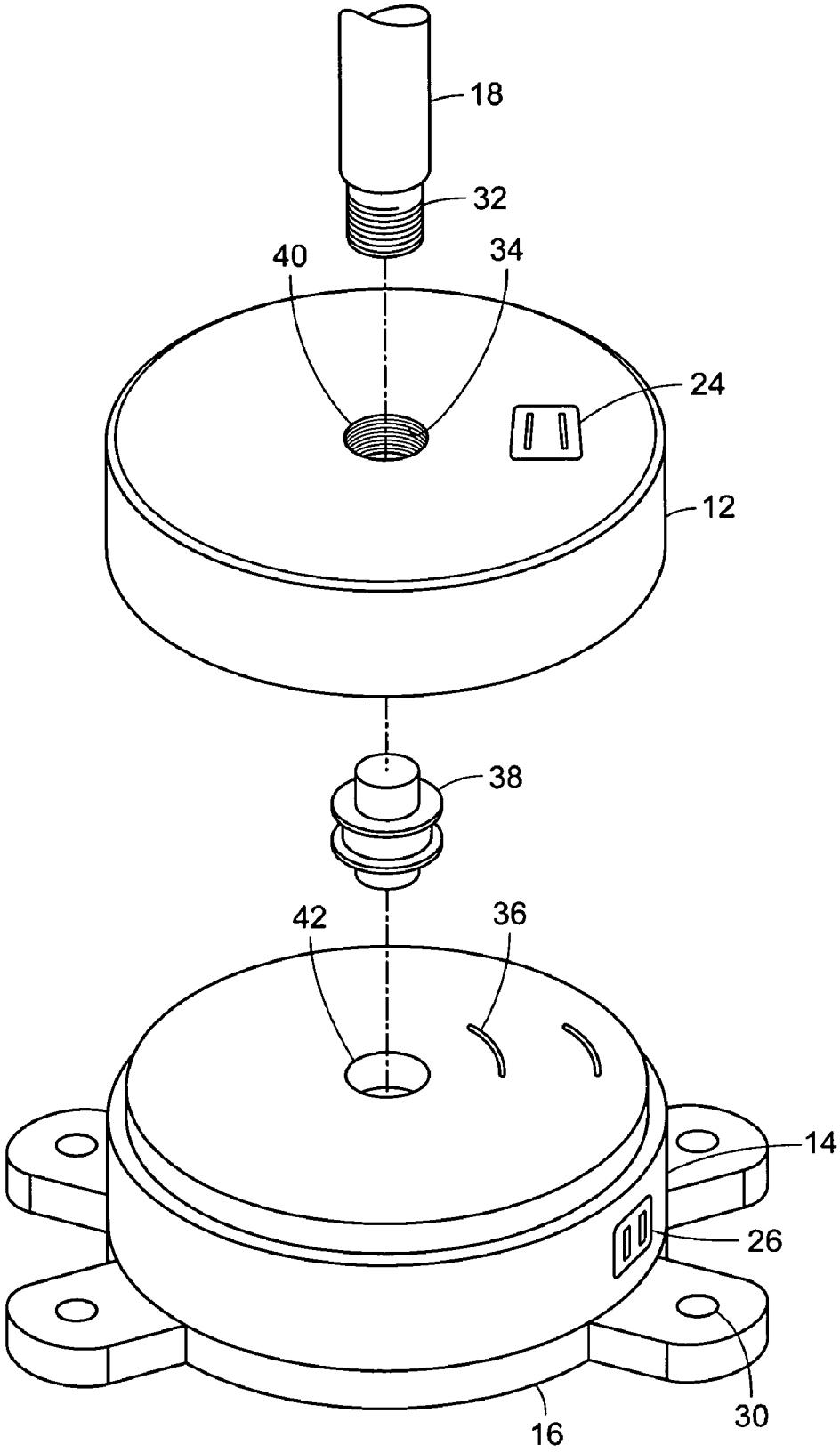
FIG. 2 is an exploded view of the Christmas ornament showing a bearing positioned between the upper hub and a lower hub for allowing relative motion thereof.
Figure 3:
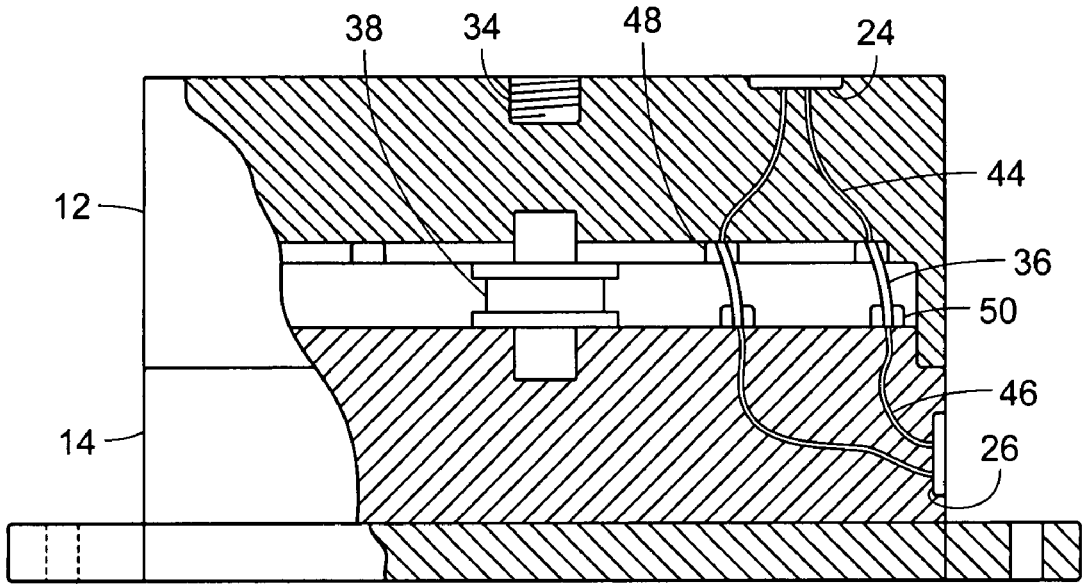
FIG. 3 is a right side elevational view with parts broken away of the upper and lower hubs depicted in the assembled Christmas ornament of FIG. 1.

FIG. 2 shows the ornament 10 being assembled. The bottom end 32 of the pole 18 is threaded so that it mates with internal grooves 34 near the top of the upper hub 12. Therefore, the user can easily screw the pole 18 into place. A bearing 38 with circular flanges fits into coaxial central holes 40 and 42 in the upper hub 12 and the lower hub 14 respectively. The bearing 38 allows the upper hub 12 to freely spin about its central axis while the lower hub 14 is motionless. The upper hub, having embedded concentric copper rings 48, as shown in FIG. 3, are in electrical communication with the outlet 24, while the lower hub, connector 50, as shown in FIG. 3, are in electrical communication with the inlet 26. The connector is curved in nature and is configured to provide electrical communication from the lower hub leads to the copper tabs 36. Consequently, whenever the cord 28 is plugged into a wall receptacle, electrical contact between the lights 22 and the power supply is maintained constantly, including when the upper hub 12 freely rotates. The platform 16 is a mountable base configured as one piece, which supports the lower hub 14, contains a plurality of holes 30 through which a user can insert bolts in order to mount the ornament 10 onto virtually any smooth surface, such as a ceiling or floor.

FIG. 3 is a right side elevational view with parts broken away of the upper hub 12 and the lower hub 14 depicted in the assembled ornament 10 of FIG. 1. A plurality of copper tabs 36 protrude from the connector 50 embedded in the lower hub 14 and extend to come into contact with the embedded concentric copper rings 48 in the upper hub 12. A pair of upper hub leads 44 extend from the outlet 24 and insert into the upper hub copper rings 48. Likewise, a pair of lower hub leads 46 extend from the inlet 24 and insert into the lower hub connector 50. The upper hub leads 44 and the lower hub leads 46 can be of any conventional type and are sized to fit within the upper hub copper rings 48 and the lower hub connector 50 respectively.

Figure 4:
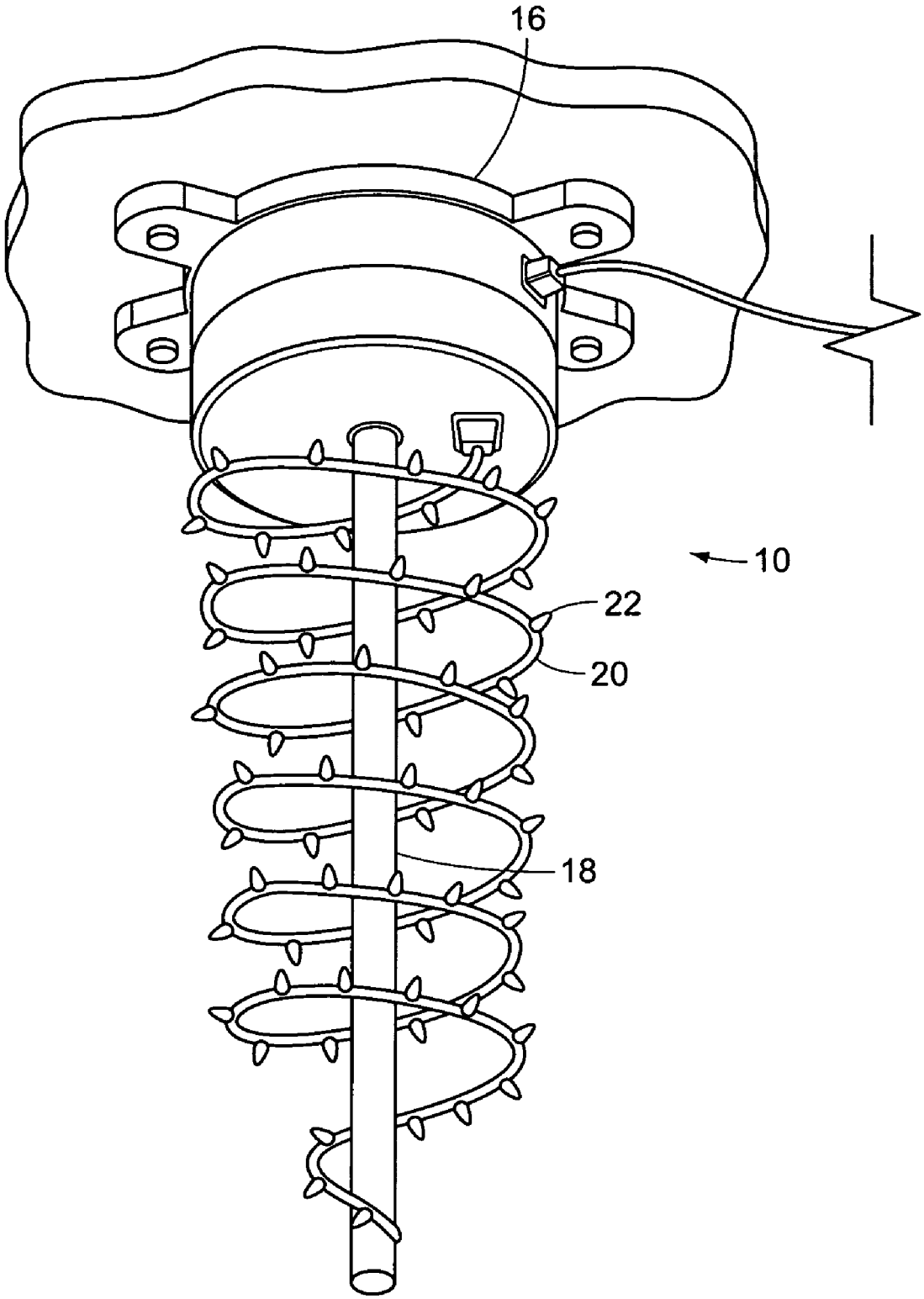
FIG. 4 is a diagrammatic perspective view of a Christmas ornament according to the present invention mounted in an inverted position and being used with a string of Christmas lights.

FIG. 4 illustrates the ornament 10 in an inverted position. The user has inserted bolts through the holes 30 of the platform 16 and into a ceiling. The pole 18 and the coil 20 are preferably constructed from a durable plastic. The coil of lights can freely rotate—either manually or motor driven.

Figure 5:
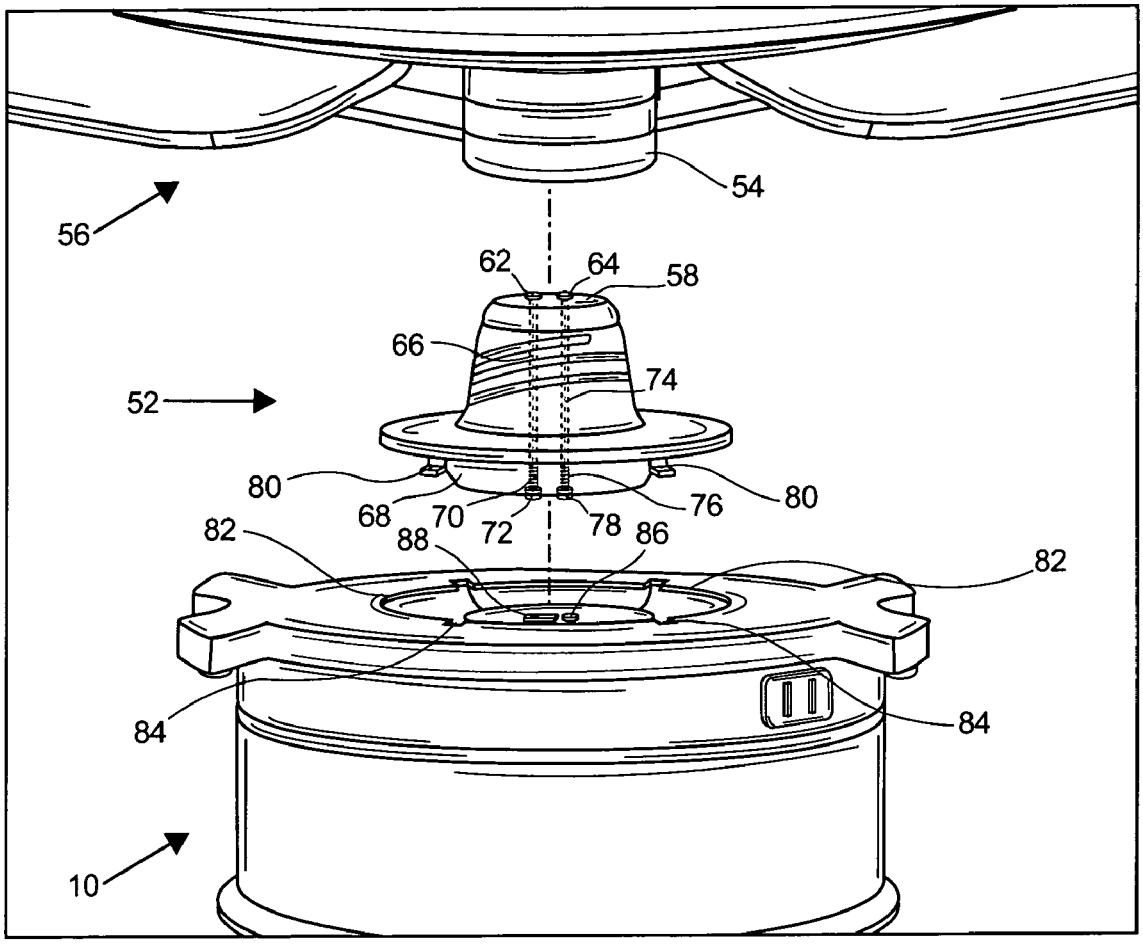
FIG. 5 is a diagrammatic perspective view of a Christmas ornament according to the present invention in an inverted position where the lower hub is connected to an adapter, which is inserted into a light bulb socket.

FIG. 5 illustrates the ornament 10 in an inverted position, where the lower hub 14 is connected to an adapter 52, which inserts into a light bulb socket 54 of a standard ceiling fan 56. The adapter 52 has a first end 58 that contains a threaded sleeve 60 which allows for insertion into socket 54. The first end 58 has a positive side contact 62 and a negative side contact 64 that are centrally located on the first end 58. The positive side contact 62 is connected by a wire 66 running from the first end 58 to a second end 68 of the adapter 52. The wire 66 makes contact with a positive side spring 70, where the spring 70 rests upon a positive ball bearing 72 on the second end 68 of the adapter 52. The negative side contact 64 is connected with a wire 74 that runs from the first end 58 to the second end 68 of the adapter 52. The wire 74 makes contact with a negative side spring 76, where the spring 76 rests upon a negative ball bearing 78 on the second end 68 of the adapter 52. Lastly, the adapter 52 contains a plurality of lock tabs 80 for connection with the lower hub 14.

In this embodiment, the lower hub 14 contains a plurality of adapter tabs 82 for receiving the lock tabs 80 on the second end 68 of the adapter 52. Additionally, the lower hub 14 contains a plurality of adapter tab locks 84 to secure the adapter 52 in place once contact is made with the lower hub 14. A user can connect adapter 52 with the lower hub 14, by pushing the lock tabs 80 of adapter 52 into the adapter tabs 82 in the lower hub 14 and turning until secured in adapter tab locks 84. To maintain electrical current, the positive ball bearing 72 comes in contact with a positive center contact 86 on the lower hub 14, and the negative ball bearing 78 comes in contact with a negative contact strip 88 on the lower hub 14. Both the positive center contact 86 and the negative contact strip 88 connect to the lower hub leads 46.

Figure 6:
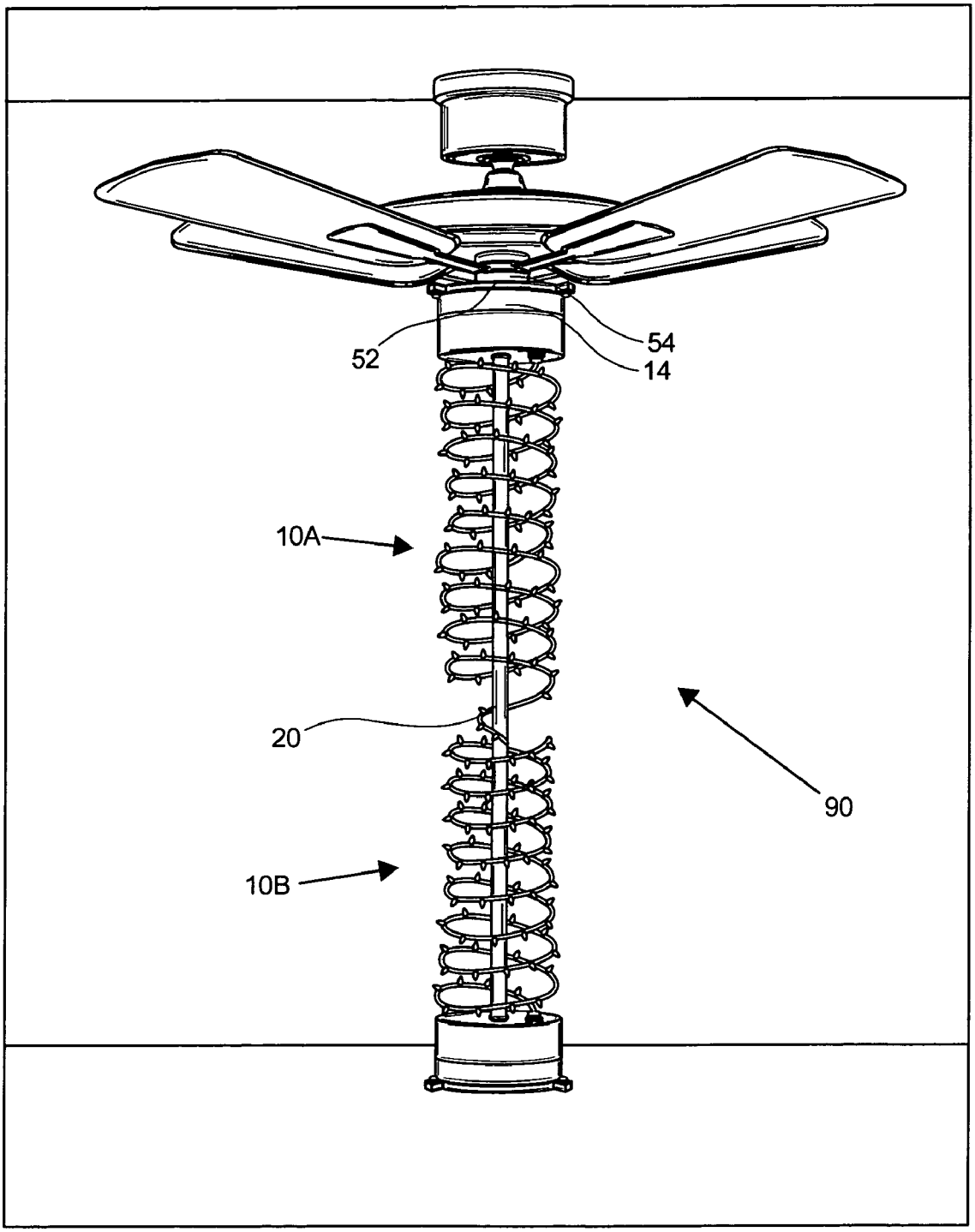
FIG. 6 is a diagrammatic perspective view of a Christmas ornament according to the present invention where two ornaments are connected in opposite positions.

FIG. 6 illustrates an alternative embodiment of the ornament 10 as described in FIG. 5. Here, a first ornament 10A is in an inverted position, wherein the lower hub 14 is connected to the adapter 52, which is inserted into the socket 54. The first ornament 10A is connected to a second ornament 10B positionable opposite to the first ornament and preferably secured or positioned on a ground surface, and the second ornament 10B is similar to one described in FIGS. 1 and 2. The combination of the first and second ornament, 10A and 10B creates one continuous unit 90.

Figure 7:
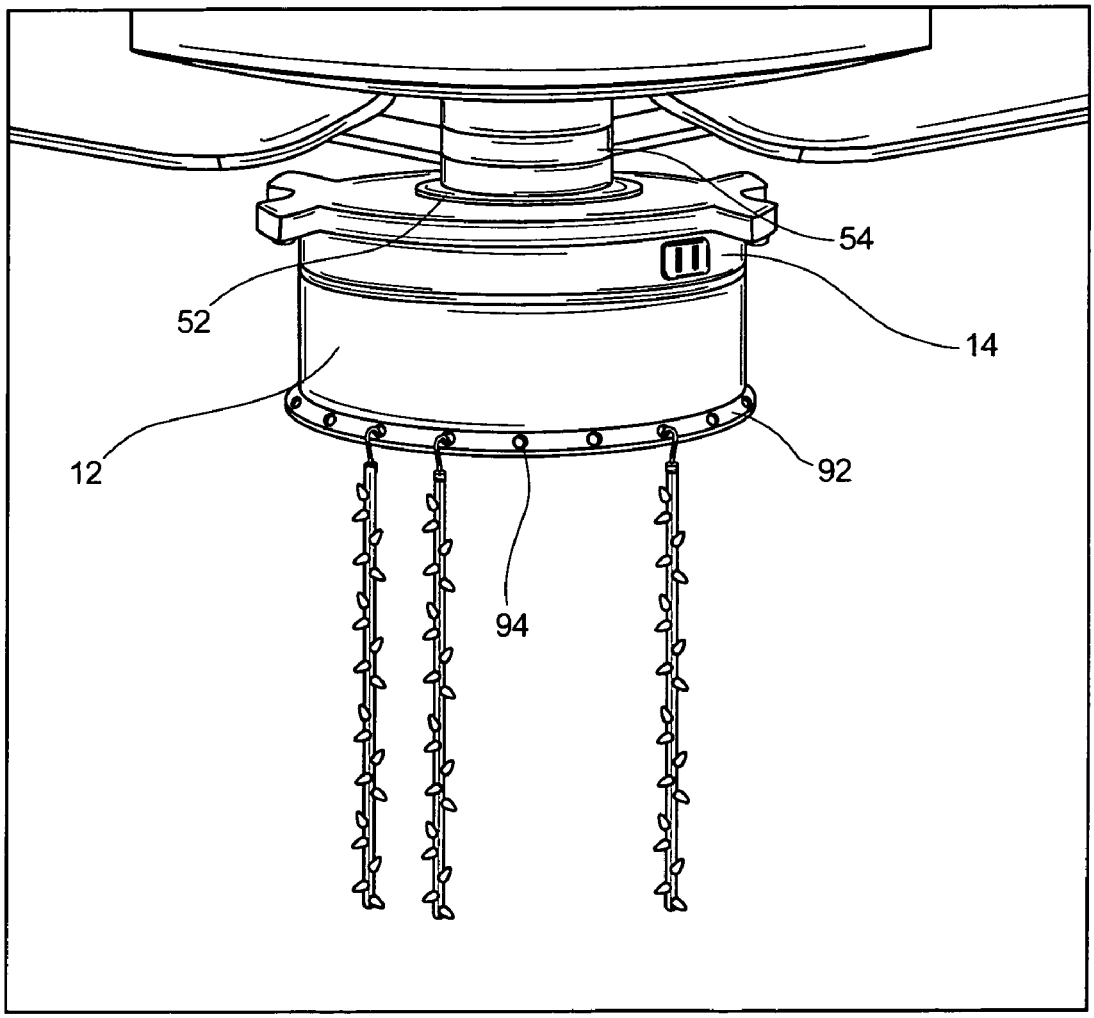
FIG. 7 is a diagrammatic perspective view of a Christmas ornament according to the present invention where the ornament is in an inverted position, with strands of light hanging from a rim located on the upper hub.

FIG. 7 illustrates an alternative embodiment of the ornament 10 as described in FIG. 5. Here the lower hub 14 is connected to the adapter 52, which is inserted into the socket 54. The upper hub 12 has a rim 92 that contains a plurality of holes 94. The holes 94 can be used to accommodate strands of lights.

In conclusion, herein is presented a spinning Christmas ornament. The invention is illustrated by example in the drawing figures, and throughout the written description. It should be understood that numerous variations are possible, while adhering to the inventive concept. Such variations are contemplated as being a part of the present invention.

What is claimed is:

1. An ornament for displaying illuminated spinning lights wherein the ornament inserts into a light bulb socket of a standard ceiling fan, comprising:

an adapter, having a first end and a second end, the first end having a threaded sleeve for insertion into the light bulb socket, the first end having a positive side contact and negative side contact centrally located thereon, the second end having a positive ball bearing and a negative ball bearing, and having a positive side spring located on the positive ball bearing and a negative side spring located on the negative ball bearing, and having a wire running from the positive side contact to the positive side spring, and having a wire running from the negative side contact to the negative side spring, and having a plurality of lock tabs;

a lower hub having a connector and an electrical inlet in communication with the connector, and having a plurality of adapter tabs locks and adapter tab located on the lower hub, where the adapter tabs are connected to a plurality of adapter tab locks to receive and secure the lock tabs located on the adapter, and having a positive center contact located on the lower hub that comes in contact with the positive ball bearing located on the adapter, and having a negative contact strip located on the lower hub that comes in contact with the negative ball bearing located on the adapter;

a pair of lower hub leads that connect to the positive center contact and negative contact strip and that extend from the inlet and are connected to the lower hub connector;

an upper hub that mounts on top of the lower hub, the upper hub having embedded concentric copper rings and an electrical outlet, the upper hub freely rotating in a clockwise or a counterclockwise direction;

a pair of upper hub leads that extend from the outlet and are connected to the upper hub embedded concentric copper rings;

a bearing with circular flanges that fits into coaxial central holes in the upper hub and the lower hub and allows relative motion of the upper hub and lower hub;

a pole that extends vertically through a center of the upper hub, the pole having a top end and a bottom end;

a coil wrapped around the pole between its top end and its bottom end, the coil having a string of lights that are plugged into the outlet; and a plurality of copper tabs in electrical communication with the outlet that protrude from the lower hub connector and extend to come into contact with the upper hub copper rings for maintaining an electrical connection between the inlet and outlet while the upper hub freely rotates with respect to the lower hub.

2. The ornament as recited in claim 1 further comprising a first ornament in an inverted position hanging from the light bulb socket from a standard ceiling fan and a second ornament positionable opposite the first ornament extending upward from a ground surface, wherein together the first and second ornament create one continuous unit.

3. An ornament for displaying illuminated spinning lights, wherein the ornament inserts into a light bulb socket of a standard ceiling fan, comprising:

an adapter, having a first end and a second end, the first end having a threaded sleeve for insertion into the light bulb socket, the first end having a positive side contact and negative side contact centrally located thereon, the second end having a positive ball bearing and a negative ball bearing, and having a positive side spring located on the positive ball bearing and a negative side spring located on the negative ball bearing, and having a wire running from the positive side contact to the positive side spring, and having a wire running from the negative side contact to the negative side spring, and having a plurality of lock tabs;

a lower hub having a connector and an electrical inlet in communication with the connector, and having a plurality of adapter tabs locks and adapter tab located on the lower hub, where the adapter tabs are connected to a plurality of adapter tab locks to receive and secure the lock tabs located on the adapter, and having a positive center contact located on the lower hub that comes in contact with the positive ball bearing located on the adapter, and having a negative contact strip located on the lower hub that comes in contact with the negative ball bearing located on the adapter;

a pair of lower hub leads that connect to the positive center contact and negative contact strip and that extend from the inlet and are connected to the lower hub connector;

an upper hub that mounts on top of the lower hub, the upper hub having embedded concentric copper rings and an electrical outlet, the upper hub freely rotating in a clockwise or a counterclockwise direction, and having a rim that contains a plurality of holes, and having a plurality of strands of lights coupled within the holes;

a pair of upper hub leads that extend from the outlet and are connected to the upper hub embedded concentric copper rings;

a bearing with circular flanges that fits into coaxial central holes in the upper hub and the lower hub and allows relative motion of the upper hub and lower hub; and a plurality of copper tabs in electrical communication with the outlet that protrude from the lower hub connector and extend to come into contact with the upper hub copper rings for maintaining an electrical connection between the inlet and outlet while the upper hub freely rotates with respect to the lower hub.

* * * * *